US008407878B2

(12) United States Patent
Gipson

(10) Patent No.: US 8,407,878 B2
(45) Date of Patent: Apr. 2, 2013

(54) TUBING CONNECTOR AND METHOD FOR COUPLING TWO COILED TUBING STRINGS

(75) Inventor: Tommie Carroll Gipson, Eaton, CO (US)

(73) Assignee: RRI Holdings, Inc., Dallas, TX (US)

( * ) Notice: Subject to any disclaimer, the term of this patent is extended or adjusted under 35 U.S.C. 154(b) by 0 days.

(21) Appl. No.: 13/199,912

(22) Filed: Sep. 13, 2011

(65) Prior Publication Data

US 2013/0038051 A1 Feb. 14, 2013

Related U.S. Application Data

(60) Provisional application No. 61/574,749, filed on Aug. 9, 2011.

(51) Int. Cl.
*B23P 11/02* (2006.01)

(52) U.S. Cl. ..... 29/451

(58) Field of Classification Search ..... 29/505, 29/428, 443, 450, 451, 453, 469, 506, 508, 29/525.13, 525.14, 234, 235, 272; 285/116, 285/232, 231, 334.5, 382.7, 343
See application file for complete search history.

(56) References Cited

U.S. PATENT DOCUMENTS 2,271,502 A * 1/1942 Snyder ..... 285/116

* cited by examiner

*Primary Examiner* — John C Hong
(74) *Attorney, Agent, or Firm* — Elizabeth R. Hall

(57) ABSTRACT

A simple flexible coiled tubing connector couples the ends of two separate sections of tubing so that mutual axial tensile forces can be transferred between the two sections. The tubing connector is intended for use with tubing which may be coiled on a storage reel and freely run through a coiled tubing straightener or tensioning device. The tubing connector is not required to contain pressure, transfer compressive axial loads, torsion, or loads transverse to the axes of the tubes.

6 Claims, 3 Drawing Sheets

TUBING CONNECTOR AND METHOD FOR COUPLING TWO COILED TUBING STRINGS

CROSS-REFERENCE TO RELATED APPLICATION

The present application, pursuant to 35 U.S.C. 111(b), claims the benefit of the earlier filing date of provisional application Ser. No. 61/574,749 filed Aug. 9, 2011, and entitled "Tensile Connection Device and Method for Coupling Two Coiled Tubing Strings."

BACKGROUND OF THE INVENTION

1. Field of the Invention

The present invention relates to a device and method for coupling the ends of two separate sections of tubing so that mutual axial tensile forces can be transferred between the two sections. The coupling device of the present invention is not restricted to coupling two aligned ends of two tubing sections.

2. Description of the Related Art

Typically, coiled tubing drillers are coupling the ends of two sections of coiled tubing by welding the two ends together. This process is difficult because it requires that the two ends be perfectly aligned before they are welded. If the two ends are not perfectly aligned before they are welded together, the nonaligned connection can get stuck in the tubing injector and require that the injector be broken down and the tubing connection be manually pulled through.

A need exists for a method of coupling the ends of two sections of coiled tubing that does not require the perfect alignment of the two ends to be coupled.

A need also exists for a method of coupling the ends of two sections of coiled tubing that allows the coupled tubing ends to pass through a coiled tubing injector unobstructed.

SUMMARY OF THE INVENTION

The present invention relates to a device and method for coupling the ends of two separate sections of tubing so that mutual axial tensile forces can be transferred between the two sections. The coupling device of the present invention is intended for use with tubing which may be coiled on a storage reel and freely run through a coiled tubing straightener or injector. The coupling device is not required to contain pressure, transfer compressive axial loads, torsion, or loads transverse to the axes of the tubes.

One embodiment of the present invention includes a tubing connector for coupling the ends of two tubing segments comprising: (a) a wire rope segment having a first end, a second end, and an interior mid-point; (b) a first rope socket attached to the wire rope segment proximal to the first end of the wire rope segment; (c) a second rope socket attached to the wire rope segment proximal to the second end of the wire rope segment; (d) a first cylindrical retainer ring slidably positioned along a length of the wire rope segment between the first rope socket and the wire rope mid-point; and (e) a second cylindrical retainer ring slidably positioned along the length of the wire rope segment between the second rope socket and the wire rope mid-point.

A second embodiment of the present invention includes a tubing connector for coupling the ends of two tubing segments comprising: (a) a first tubing segment and a second tubing segment; (b) a wire rope segment having a first end, a second end, and an interior mid-point; (c) a first rope socket attached to the wire rope segment proximal to the first end of the wire rope segment and positioned within an internal diameter of a segmented interior end of the first tubing segment; (d) a second rope socket attached to the wire rope segment proximal to the second end of the wire rope segment and positioned within an internal diameter of a segmented interior end of the second tubing segment; (e) a first cylindrical retainer ring positioned along a length of the wire rope segment between the first rope socket and the wire rope mid-point, wherein the first retainer ring is mounted on the interior end of the first tubing segment; and (f) a second cylindrical retainer ring positioned along the length of the wire rope segment between the second rope socket and the wire rope mid-point, wherein the second retainer ring is mounted on the interior end of the second tubing segment.

Another embodiment of the present invention includes a method for coupling the ends of two tubing segments comprising: (a) notching an internal end of a first tubing segment with a plurality of end notches and an internal end of a second tubing segment with a plurality of end notches; (b) aligning a first end of a tubing connector with the internal end of the first tubing segment and a second end of the tubing connector with the internal end of the second tubing segment, wherein the tubing connector comprises (i) a wire rope segment having a first end, a second end, and an interior mid-point; (ii) a first rope socket having an interior end facing the wire rope mid-point and an exterior end attached to the wire rope segment proximal to the first end of the wire rope segment; (iii) a second rope socket having an interior end facing the wire rope mid-point and an exterior end attached to the wire rope segment proximal to the second end of the wire rope segment; (iv) a first cylindrical retainer ring slidably positioned along a length of the wire rope segment between the first rope socket and the wire rope mid-point; and (v) a second cylindrical retainer ring slidably positioned along the length of the wire rope segment between the second rope socket and the wire rope mid-point; (c) inserting the interior end of the first rope socket into a bore of the notched internal end of the first tubing segment and the interior end of the second rope socket into a bore of the notched internal end of the second tubing segment; (d) inwardly bending the end notches of the first tubing segment toward a tapered end nose of the first rope socket and the end notches of the second tubing segment toward a tapered end nose of the second rope socket; (e) sliding a first end of a bore of the first retainer ring onto the bent end notches of the first tubing section and a first end of a bore of the second retainer ring onto the bent end notches of the second tubing section; and (f) attaching several points of the first end of the bore of the first retainer ring onto the bent end notches of the first tubing section and several points of the first end of the bore of the second retainer ring onto the bent end notches of the second tubing section.

Another embodiment of the present invention includes a method for coupling the ends of two tubing segments comprising: (a) notching an internal end of a first tubing segment with a plurality of end notches and an internal end of a second tubing segment with a plurality of end notches; (b) obtaining a tubing connector comprising (i) a wire rope segment having a first end, a second end, and an interior mid-point; (ii) a first rope socket having an interior end facing the wire rope mid-point, wherein said interior end has an inwardly converging frustroconical nose section on an outer surface of the interior end of the first rope socket; (iii) a second rope socket having an interior end facing the wire rope mid-point, wherein said interior end has an inwardly converging frustroconical nose section on an outer surface of the interior end of the second rope socket; (iv) a first cylindrical retainer ring slidably positioned along a length of the wire rope segment between the first rope socket and the wire rope mid-point; and (v) a second cylindrical retainer ring slidably positioned along the length of the wire rope segment between the second rope socket and the wire rope mid-point; (c) attaching an exterior end of the first rope socket to the wire rope segment proximal to the first end of the wire rope segment with a smelter connection; (d) attaching an exterior end of the second rope socket to the wire rope segment proximal to the second end of the wire rope segment with a smelter connection; (e) aligning a first end of the tubing connector with the internal end of the first tubing segment; (f) aligning a second end of the tubing connector with the internal end of the second tubing segment; (g) inserting the interior end of the first rope socket into a bore of the notched internal end of the first tubing segment; (h) inserting the interior end of the second rope socket into a bore of the notched internal end of the second tubing segment; (i) inwardly bending the end notches of the first tubing segment toward the nose of the first rope socket and the end notches of the second tubing segment toward the nose of the second rope socket; (j) sliding a first end of a bore of the first retainer ring onto the bent end notches of the first tubing section and a first end of a bore of the second retainer ring onto the bent end notches of the second tubing section; and (k) welding several points of the first end of the bore of the first retainer ring onto the bent end notches of the first tubing section and several points of the first end of the bore of the second retainer ring onto the bent end notches of the second tubing section.

The foregoing has outlined rather broadly several aspects of the present invention in order that the detailed description of the invention that follows may be better understood and thus is not intended to narrow or limit in any manner the appended claims which define the invention. Additional features and advantages of the invention will be described hereinafter which form the subject of the claims of the invention. It should be appreciated by those skilled in the art that the conception and the specific embodiment disclosed may be readily utilized as a basis for modifying or designing of the structures for carrying out the same purposes as the invention. It should be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

Embodiments of the present invention relate to a tubing connector for coupling the ends of two separate sections of tubing and to the methods for using the tubing connector. The coupling device of the present invention is intended for use with tubing which may be coiled on a storage reel and freely run through a coiled tubing straightener or coiled tubing injector.

The tubing connector couples the ends of two separate sections of tubing so that mutual axial tensile forces can be transferred between the two sections. The tubing connector is not required to contain pressure, transfer compressive axial loads, torsion, or loads transverse to the axes of the tubes.

Figure 1:
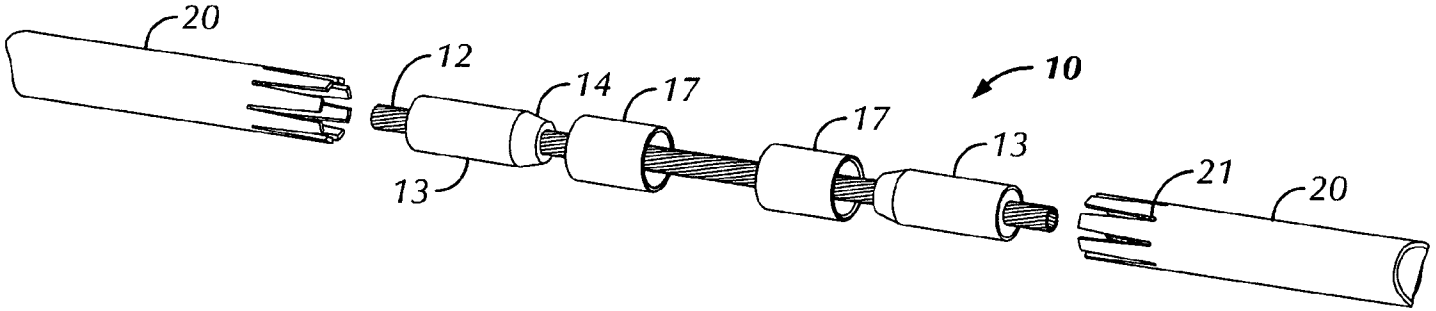
FIG. 1 is an oblique side view of the device of the present invention positioned between two spaced apart and substantially axially aligned opposed tubing ends from separate sections of tubing.
Figure 2:
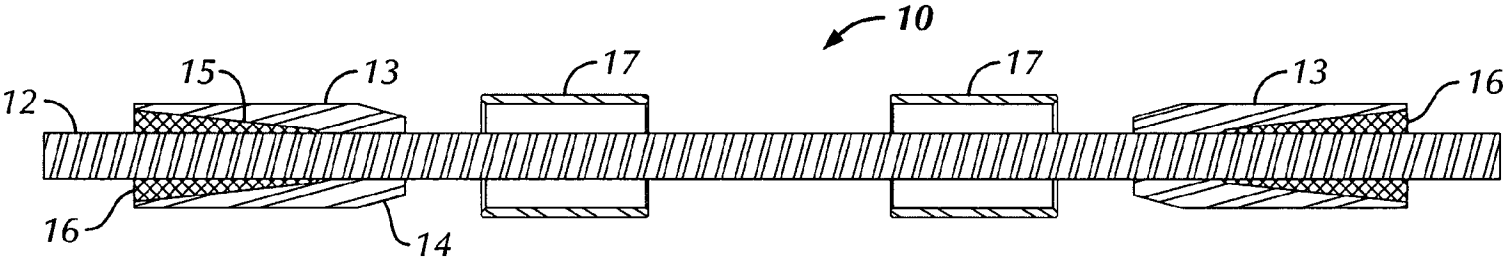
FIG. 2 is a longitudinal sectional view of the apparatus of the coupling device of the present invention.

The tubing connector 10 of the present invention, shown in FIGS. 1 and 2, includes a flexible wire rope 12, two cylindrical wire rope sockets 13, and a pair of annular retainer rings 17. Typically each of the component parts of the tubing connector 10, also referred to herein as a coupling device, is made of steel.

Referring to FIG. 1, the tubing connector 10 is seen coaxially positioned between the opposed ends of two tubing strings which are to be interconnected by the coupling device 10. The tubing connector 10 has a primary flexible segment of a wire rope 12 that runs between the two tubing strings. The opposed ends of the mirror image rigid cylindrical wire rope sockets 13 are attached to the wire rope 12 proximal to the opposed ends of the wire rope 12. The two annular retainer rings 17 are positioned between the wire rope sockets 13.

The steel wire rope 12 may be any sufficiently strong commercial product. Such ropes are generally made of multiple helically wound smaller strands. Nonmetallic core wire ropes are generally unsatisfactory for use with the present invention because of damage to the core and connection degradation due to thermal degradation of the core by the molten zinc spelter material described below.

The wire rope sockets 13 have an elongated right circular cylindrical outer surface with a short inwardly converging frustroconical nose section 14 at a first end. The taper angle of the frustroconical nose 14 is approximately 15° to 30°. At the opposed second end of the wire rope sockets 13, an elongated inwardly converging frustroconical bore 15 coaxial with the outer surface extends approximately 50% to 75% of the length of the rope sockets 13. At its internal end facing the retainer ring 17, the frustroconical bore 15 is joined to a straight bore which has a close slip fit to the exterior of the wire rope 12.

Prior to connecting the wore rope sockets 13 to the segment of the wire rope 12, a retainer ring 17 is slidably positioned along the wire rope 12 inward of the two rope sockets 13. The retainer rings 17 are cylinders with axially short bodies of rotation and transverse ends, right circular cylindrical exterior surfaces, small interior and exterior end chamfers. The outer diameter of the retainer rings 17 is the same or slightly smaller than the outer diameter of the two tubing ends to be joined by the tubing connector 10. The inner diameter of the retainer rings 17 is larger than the external diameter of the rope sockets 13.

Installation of the Tubing Connector

The installation of the tubing connector 10 begins by coaxially attaching each wire rope socket 13 to the wire rope 12 by a cast zinc or zinc alloy spelter connection 16. This spelter connection 16 is made by first melting zinc or a zinc alloy in a ladle and then pouring it into the upwardly facing frustroconical bore 15 of each rope socket 13 when the wire rope 12 is present. As the zinc or zinc alloy cools, it forms a rigid, strong spelter connection 16 between the rope socket 13 and the wire rope 12. The rope sockets 13 are spaced apart, generally symmetrically, about the midpoint of the wire rope 12 with their frustroconical noses 14 positioned on the inward side. The attachment of the rope sockets 13 to the wire rope 12 with the spelter connection 16 internalizes the pair of opposed retainer rings 17 between the wire rope sockets 13.

Prior to installing the wire rope sockets 13 to the segment of the wire rope 12 the two tubing ends 20 to be coupled are notched or segmented. Generally each tubing end is notched to create a number of arcuate segments 22 as shown in FIG. 1. The number of arcuate segments will vary but generally ranges from about 8 to 12 notches.

Typically, multiple equispaced identical elongated end notches 21 are cut to a length of approximately 1.0-1.7 times the internal tube diameters. As shown in the drawings, the notches are generally tapered, but alternatively they could have parallel sides if the slits are sufficiently wide. The gaps resulting between the arcuate segments from the slitting of the tubing ends must be sufficient to permit the ends to bend radially inwardly without mutual interference.

Figure 3:
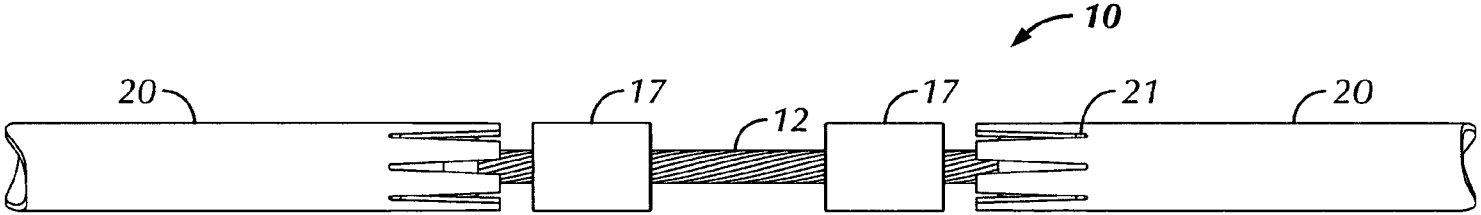
FIG. 3 is a side profile view which shows the device of the present invention positioned interior to the ends of two approximately coaxial tubing sections preparatory to establishing a mechanical connection therebetween.
Figure 5:
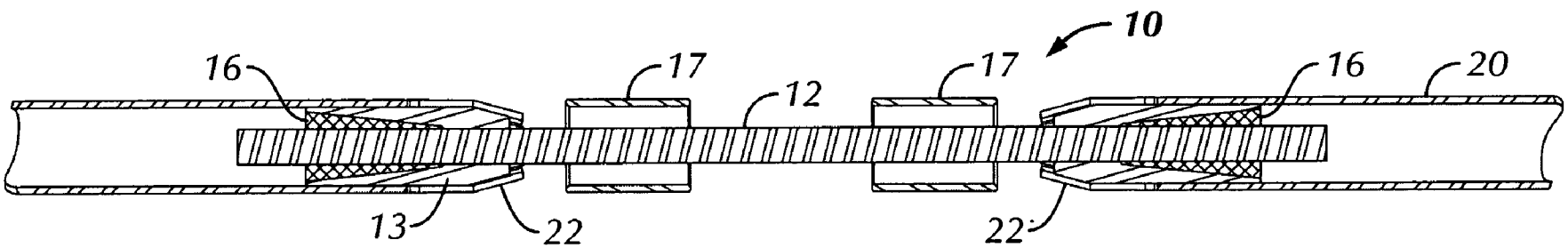
FIG. 5 is a longitudinal sectional view corresponding to FIG. 4, but showing the inwardly bent arcuate sections of the tubing ends, wherein the bending is done by hammering the ends of the tubes.
Figure 6:
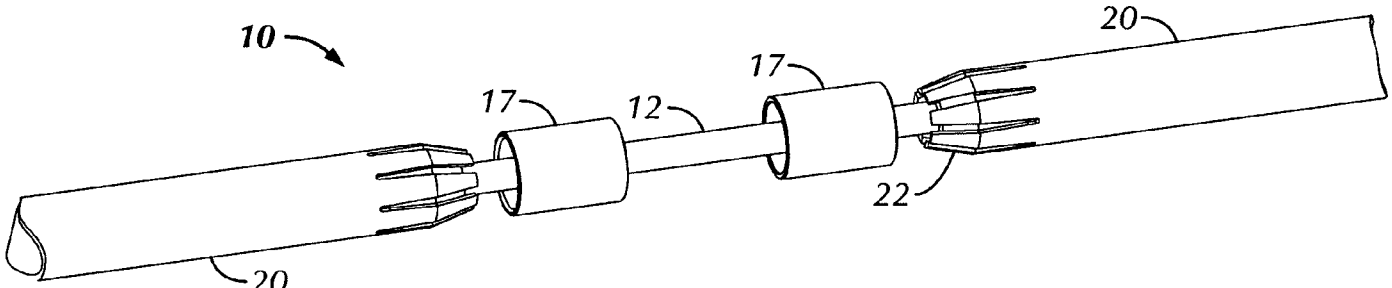
FIG. 6 is an oblique view which corresponds to FIG. 5.

Referring to FIGS. 3, 5 and 6, the sequence of steps to bend the split arcuate end segments of the tubing 20 is shown. The segmentation of the tubing ends 20 ease the inward bending of the arcuate segments 22 to effect the installation of the tubing connector 10.

Figure 4:
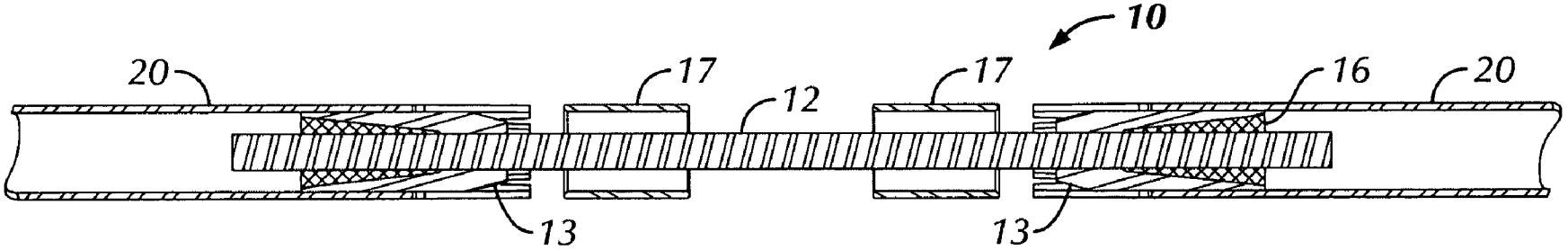
FIG. 4 is a longitudinal sectional view corresponding to FIG. 3.

In FIGS. 3 and 4, the tubing ends 20 are generally aligned. However, the tubing ends 20 do not have to be perfectly aligned as the wire rope segment 12 in the tubing connector 10 provides the tubing connector 10 with some flexibility.

The rope sockets 13 are positioned so that their opposed ends are securely placed within the segmented ends of the tubing 20. The inward placement of the interior ends of the rope sockets 13 within the tubing ends should be approximately a distance of about 10% to 35% of the internal diameter of the tubing.

Once the rope sockets are securely positioned within the tubing ends, the retainer rings 17 are first slid away from the tubing ends toward the middle of the wire rope 12. The outer ends of the arcuate segments 22 are then hammered radially inwardly until they contact the frustroconical nose 14 of their respective rope sockets 13. The bent arcuate segments 22 of each tubing end are a close fit to the frustroconical nose 14 of their respective rope sockets 13.

Figure 7:
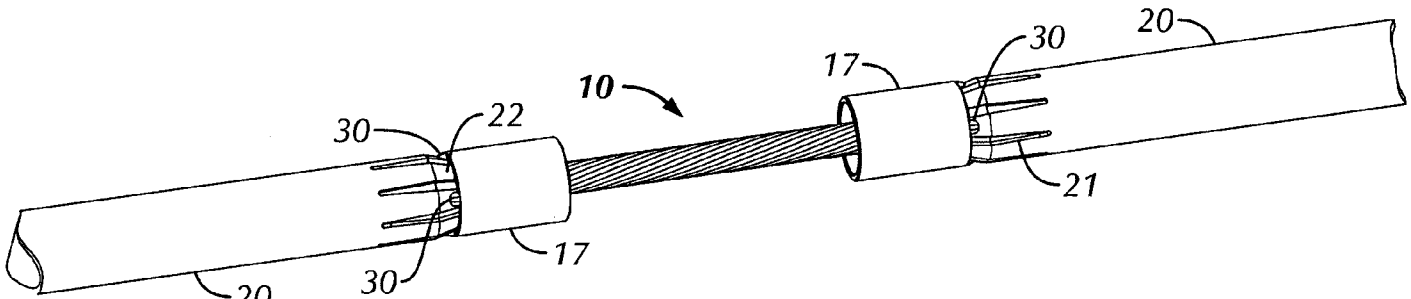
FIG. 7 is an oblique side view of a completed connection between the two tube sections, wherein the retainer rings have been welded to the bent arcuate sections of the tubing ends.
Figure 8:
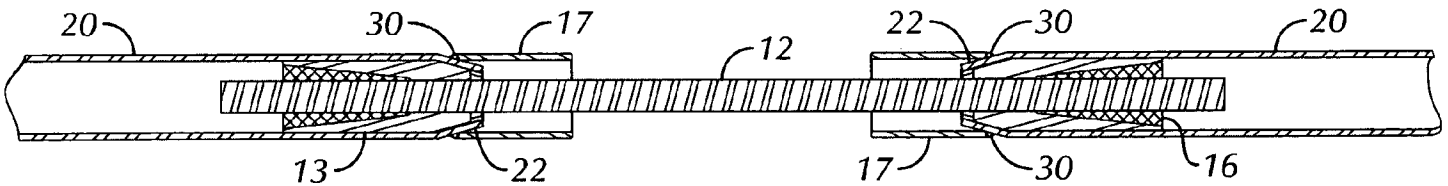
FIG. 8 is a longitudinal sectional view corresponding to FIG. 7 of the completed connection established between the tubes by the present invention.

Following the inward bending of the arcuate segments 22, each of the two retainer rings 17 is moved axially outwardly towards the closest tubing end 20 and rope socket 13 until the outer transverse end of the retainer ring 17 abuts the inwardly bent arcuate segments 22. With the retainer rings 17 held in the abutted position, one or more welds 30 per retainer ring 17 is made to fixedly attach the retainer ring 17 to the inwardly bent arcuate segments 22 of their respective tube ends. This results in the installation of the tubing connector 10 and the configuration of the connection shown in FIGS. 7 and 8.

The abutment of interior sides of the inwardly bent arcuate segments 22 of the tubing 20 ends with the frustroconical shoulders 14 of the rope sockets 13 resists tension loads transferred through the segment of the wire rope 12 to the two tubes. The welded attachment of the retainer rings 17 to the arcuate segments 22 is sufficiently strong to prevent outward bending of the arcuate segments.

ADVANTAGES OF THE INVENTION

The tubing connector 10 disclosed herein is inexpensive and sufficiently strong to ensure that the two tubing strings are reliably coupled when being handled. The connections can be rapidly made using simple tools. The spelter connections between the rope sockets 13 and the wire rope 12 can be prepared in advance of the need to make a connection, so minimal on site labor is needed to make a connection.

One major advantage to using the tubing connector 10 is that the two ends of the tubing segments to be joined do not have to be perfectly aligned in order to couple the tubing ends with the tubing connector 10. The flexibility of the wire rope 12 of the tubing connector 10 allows some variation in the alignment of the two tubing ends. Previously when two tubing ends were coupled by welding, the two tubing ends had to be perfectly aligned to join the two ends. Trying to perfectly align the two tubing ends on site is dangerous for the personnel that have to manipulate the coiled tubing ends as the coiled tubing is moved into position.

Another advantage in using the flexible tubing connector 10 is that the coupled tubing ends can pass through a tubing straightener or a coiled tubing injector without getting caught on the rollers, or other components of the injector. Since the coupled tubing ends can pass through the tubing injector unobstructed, there is no need to take the tubing injector apart to free tubing connections that have been caught up in the injector.

Although the present invention has been described in detail, it should be understood that various changes, substitutions and alterations can be made herein without departing from the spirit and scope of the invention as defined by the appended claims. As may be understood readily by those skilled in the art, certain variations in the structure of the present invention may be made without departing from the spirit of the invention. For instance, the shape and dimensions of the component parts of the tubing connector 10 can be varied. These and other minor changes can be made without departing from the spirit of the invention.

What is claimed is:

1. A method for coupling the ends of two tubing segments comprising:

(a) notching an internal end of a first tubing segment with a plurality of end notches and an internal end of a second tubing segment with a plurality of end notches;

(b) aligning a first end of a tubing connector with the internal end of the first tubing segment and a second end of the tubing connector with the internal end of the second tubing segment, wherein the tubing connector comprises (i) a wire rope segment having a first end, a second end, and an interior mid-point;

(ii) a first rope socket having an interior end facing the wire rope mid-point and an exterior end attached to the wire rope segment proximal to the first end of the wire rope segment;

(iii) a second rope socket having an interior end facing the wire rope mid-point and an exterior end attached to the wire rope segment proximal to the second end of the wire rope segment;

(iv) a first cylindrical retainer ring slidably positioned along a length of the wire rope segment between the first rope socket and the wire rope mid-point; and (v) a second cylindrical retainer ring slidably positioned along the length of the wire rope segment between the second rope socket and the wire rope mid-point;

(c) inserting the interior end of the first rope socket into a bore of the notched internal end of the first tubing segment and the interior end of the second rope socket into a bore of the notched internal end of the second tubing segment;

(d) inwardly bending the end notches of the first tubing segment toward a tapered end nose of the first rope socket and the end notches of the second tubing segment toward a tapered end nose of the second rope socket;

(e) sliding a first end of a bore of the first retainer ring to abut the bent end notches of the first tubing segment and a first end of a bore of the second retainer ring to abut the bent end notches of the second tubing segment; and (f) attaching several points of the first end of the bore of the first retainer ring to the bent end notches of the first tubing section and several points of the first end of the bore of the second retainer ring to the bent end notches of the second tubing section.

2. The method of claim 1, wherein the tubing connector is flexible and the aligned first end of the tubing connector is in a non-linear relationship with the aligned second end of the tubing connector.

3. The method of claim 1, wherein the internal end of the first and second tubing segments are notched with multiple equispaced tapered end notches.

4. The method of claim 1, further comprising the step of attaching the exterior end of the first and second rope socket to the wire rope segment with a smelter connection.

5. A method for coupling the ends of two tubing segments comprising:

(a) notching an internal end of a first tubing segment with a plurality of end notches and an internal end of a second tubing segment with a plurality of end notches;

(b) obtaining a tubing connector comprising (i) a wire rope segment having a first end, a second end, and an interior mid-point;

(ii) a first rope socket having an interior end facing the wire rope mid-point, wherein said interior end has a nose section on an outer surface of the interior end of the first rope socket;

(iii) a second rope socket having an interior end facing the wire rope mid-point, wherein said interior end has a nose section on an outer surface of the interior end of the second rope socket;

(iv) a first cylindrical retainer ring slidably positioned along a length of the wire rope segment between the first rope socket and the wire rope mid-point; and (v) a second cylindrical retainer ring slidably positioned along the length of the wire rope segment between the second rope socket and the wire rope mid-point;

(c) attaching an exterior end of the first rope socket to the wire rope segment proximal to the first end of the wire rope segment with a smelter connection;

(d) attaching an exterior end of the second rope socket to the wire rope segment proximal to the second end of the wire rope segment with a smelter connection;

(e) aligning a first end of the tubing connector with the internal end of the first tubing segment;

(f) aligning a second end of the tubing connector with the internal end of the second tubing segment;

(g) inserting the interior end of the first rope socket into a bore of the notched internal end of the first tubing segment;

(h) inserting the interior end of the second rope socket into a bore of the notched internal end of the second tubing segment;

(i) inwardly bending the end notches of the first tubing segment toward the nose section of the first rope socket and the end notches of the second tubing segment toward the nose section of the second rope socket;

(j) sliding a first end of a bore of the first retainer ring to contact the bent end notches of the first tubing segment and a first end of a bore of the second retainer ring to contact the bent end notches of the second tubing segment; and (k) welding several points of the first end of the bore of the first retainer ring to the bent end notches of the first tubing segment and several points of the first end of the bore of the second retainer ring to the bent end notches of the second tubing segment.

6. The method of claim 5, wherein the wire rope segment of the tubing connector coupling the two tubing segments is flexible.

* * * * *